US009788675B1

(12) United States Patent
Hodgdon

(10) Patent No.: US 9,788,675 B1
(45) Date of Patent: Oct. 17, 2017

(54) SHOWER CURTAIN HOOK DEVICE

(71) Applicant: David Hodgdon, Medway, MA (US)

(72) Inventor: David Hodgdon, Medway, MA (US)

( * ) Notice: Subject to any disclaimer, the term of this patent is extended or adjusted under 35 U.S.C. 154(b) by 0 days.

(21) Appl. No.: 15/362,676

(22) Filed: Nov. 28, 2016

(51) Int. Cl.
*A47H 1/18* (2006.01)
*A47K 3/38* (2006.01)

(52) U.S. Cl.
CPC *A47H 1/18* (2013.01); *A47K 3/38* (2013.01)

(58) Field of Classification Search
CPC ..... A47H 1/18; A47H 13/00; A47H 15/00; A47K 3/38; Y10T 16/353
USPC ..... 16/87.2; 24/716; 160/330, DIG. 6; 4/610
See application file for complete search history.

(56) References Cited

U.S. PATENT DOCUMENTS 2,320,308 A * 5/1943 Silverman ..... A47H 15/00 16/87.2
2,840,155 A * 6/1958 Stern ..... A47H 13/00 16/87.2
5,339,884 A * 8/1994 Angerman ..... A47H 13/02 16/87.2
5,586,375 A * 12/1996 Cooperman ..... A47K 3/38 16/87.2
5,787,954 A * 8/1998 Herrera ..... A47K 3/38 16/87.2
5,894,642 A * 4/1999 Eberhardt ..... A47H 13/16 160/124
6,098,246 A * 8/2000 Moir ..... E06B 9/367 16/87.2
7,003,848 B2 * 2/2006 Ho ..... A47H 13/04 16/87.2
7,748,673 B2 * 7/2010 Barrese ..... A47H 13/00 24/716
9,578,995 B2 * 2/2017 Hanley ..... A47H 13/04
2010/0299870 A1 * 12/2010 Yeh ..... A47K 3/38 16/87.2
2012/0291243 A1 * 11/2012 Baines ..... A47K 3/38 24/716
2016/0088977 A1 * 3/2016 Hanley ..... A47K 3/38 16/87.8

* cited by examiner

*Primary Examiner* — William Miller
(74) *Attorney, Agent, or Firm* — RG Patent Consulting, LLC; Rachel Gilboy

(57) ABSTRACT

A two piece suspension device for a shower curtain and a shower liner. One piece fits over a shower curtain rod and includes a spherical end for loops on a shower curtain. There is a pair of connectors for a shower liner. A shower liner is placed between a first liner connector and a second liner connector and is held in place when the connectors are snapped together. A plurality of the shower curtain hook devices, depending on the number of loops in a shower curtain, is used to suspend the shower curtain and shower liner.

9 Claims, 4 Drawing Sheets

SHOWER CURTAIN HOOK DEVICE

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. FIELD OF THE INVENTION

The present invention relates generally to the field of shower curtain devices and more specifically relates to a shower curtain hook device.

2. DESCRIPTION OF THE RELATED ART

Hanger devices for hanging shower curtains, drapery and other hanging materials are known for hanging materials to provide privacy for individuals. Such known hanger devices include curtain rings, single hooks, and double hooks. Curtains rings are often difficult to engage and disengage from the curtains and the rod; they are manufactured in limited design styles, and they often only provide a single curtain engaging member from which it is difficult to hang, access, remove and/or replace two or more curtains or hanging materials. Single hooks require a user to remove the hook from the rod each time a curtain is removed or replaced, the user is potentially required to remove and replace both curtains when accessing a single curtain, and the curtains often slip from the hook when the hooks are moved horizontally across the rod.

Typical curtains are hung from a support rod using curtain hooks adapted for attachment to a top edge portion of the curtain and are also adapted for attachment to the support rod. Known curtain hooks have been shaped to engage an edge portion of a curtain and then engage a curtain rod. Alternately, known curtain hooks may engage the curtain rod first, either removably or permanently, and then engage the edge portion of the curtain. Typical shapes include C-shape or C-shape curtain hooks, which can be engaged with the curtain and curtain rod. These shaped hooks provide easy installation and removal of the curtain from the rod, but also allow for inadvertent detachment of the curtain from the rod.

O-shaped hooks, with at least one break in the perimeter, can be similarly attached to the curtain edge portion or the support rod. The ends formed by the break may be adapted to be rejoined. If the ends formed by the break in the perimeter are not rejoined, the O-shaped hooks have characteristics like the C-shaped hooks. Rejoining the ends can be an onerous task.

Various attempts have been made to solve the above-mentioned problems such as those found in U.S. Pat. No. 5,894,642 to Stephanie A. Eberhardt; U.S. Pat. No. 5,787, 954 to Frederick F. Herrera; and U.S. Pat. No. 5,771,504 to Merill R. Steiner. This prior art is representative of shower curtain devices. None of the above inventions and patents, taken either singly or in combination, is seen to describe the invention as claimed.

Ideally, a shower curtain hook device should provide easy removal and replacement of a shower curtain and liner and, yet would operate reliably and be manufactured at a modest expense. Thus, a need exists for a reliable shower curtain hook device to avoid the above-mentioned problems.

BRIEF SUMMARY OF THE INVENTION

In view of the foregoing disadvantages inherent in the known shower curtain device art, the present invention provides a novel shower curtain hook device. The general purpose of the present invention, which will be described subsequently in greater detail is to provide easy removal and replacement of a shower curtain and liner.

A shower curtain hook device for use in removing and replacing a shower curtain and shower liner is disclosed herein, in a preferred embodiment, comprising a curtain suspending member adapted to suspend a shower curtain and a shower liner onto a shower curtain rod. The curtain suspending member includes a curtain end adapted to fit into a loop of a shower curtain, a first liner connector having a protrusion adapted to suspend a shower liner, a rod end adapted to fit onto a shower curtain rod, and a connecting section adapted to join the curtain end, the first liner connector, and the rod end. The shower curtain hook device further comprises a second liner connector having a receiver with holding tabs protruding from the receiver adapted to join with the protrusion of the first liner connector for suspending a shower liner. The protrusion fits into the holding tabs of the receiver thereby joining the first liner connector and the second liner connector. The first liner connector and the second liner connector, when joined, are adapted to hold a shower liner between them.

The curtain suspending member, formed from plastic material, includes the curtain end, the first liner connector, the rod end and the connecting section as a continuous unit to form the curtain suspending member. The second liner connector is also formed from plastic material.

The first liner connector is formed having a circular shape including a diameter of approximately one inch and a depth, including the protrusion, of approximately three fourths of an inch. The protrusion is formed as a nipple having a length of approximately three eights of an inch and a diameter of approximately three eights of an inch.

The second liner connector is formed having a circular shape with a diameter of approximately one inch and a depth of approximately three fourths of an inch. The receiver is formed as a circle shape having five holding tabs adapted to accept the protrusion. Each of the five holding tabs is curved having a length of approximately three eights of an inch and a width of approximately one fourth of an inch. Each of the five holding tabs is fixedly attached to the receiver. The protrusion of the first liner connector is held in place within the holding tabs via friction resulting from the protrusion and the receiver.

The curtain end is formed having a spherical shape. The connecting section is formed having a V-shaped bend adjacent to the first liner connector. The rod end is formed as a C-shaped hook having an opening measuring approximately one and one half inch.

The present invention holds significant improvements and serves as a shower curtain hook device. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, a shower curtain hook device constructed and operative according to the teachings of the present invention.

DETAILED DESCRIPTION

As discussed above, embodiments of the present invention relate to a shower curtain device and more particularly to a shower curtain hook device as used to improve the removal and replacement of a shower curtain and liner.

Generally speaking, a shower curtain hook device is a two piece suspension device for a shower curtain and a shower liner. One piece fits over a shower curtain rod and includes a spherical end for loops on a shower curtain. There is a pair of connectors for a shower liner. A shower liner is placed between a first and a second liner connector and is held in place when the connectors are snapped together. A plurality of the shower curtain hook devices, depending on the number of loops in a shower curtain, is used to suspend the shower curtain and shower liner.

Figure 1:
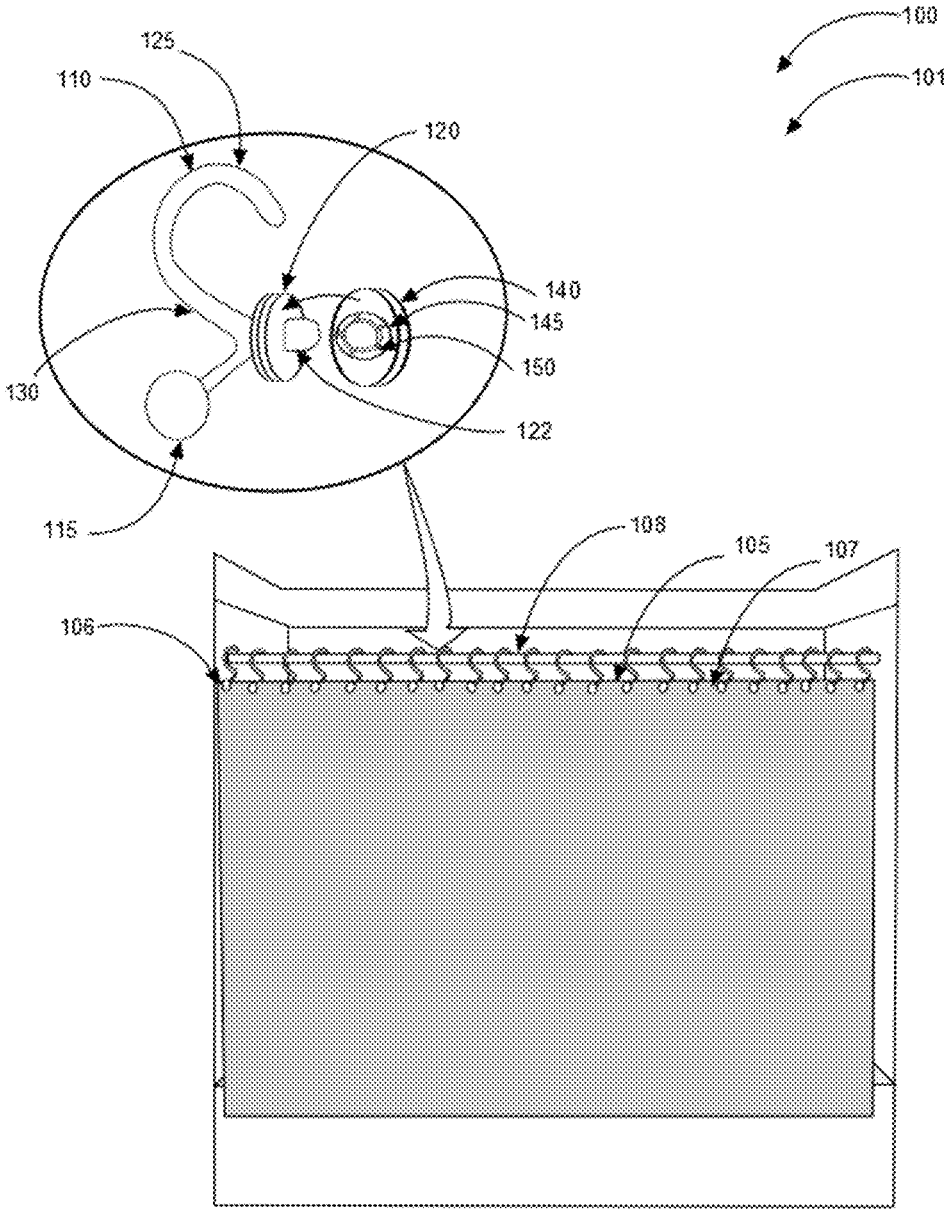
FIG. 1 shows a perspective view illustrating a shower curtain hook device in an in use condition according to an embodiment of the present invention.

Referring to the drawings by numerals of reference there is shown in FIG. 1, perspective view illustrating shower curtain hook device 100 in an in use condition 101 according to an embodiment of the present invention.

Shower curtain hook device 100 for use in removing and replacing shower curtain 105 and shower liner 106 is disclosed herein, in a preferred embodiment, comprising curtain suspending member 110 adapted to suspend shower curtain 105 and shower liner 107 onto shower curtain rod 108. Curtain suspending member 110 includes curtain end 115 adapted to fit into loop 106 of shower curtain 106, first liner connector 120 having protrusion 122 adapted to suspend shower liner 107, rod end 125 adapted to fit onto shower curtain rod 108, and connecting section 130 adapted to join curtain end 115, first liner connector 120, and rod end 125. Shower curtain hook device 100 further comprises second liner connector 140 having receiver 145 with holding tabs 150 protruding from receiver 145 adapted to join with protrusion 122 of first liner connector 120 for suspending shower liner 107. Protrusion 122 fits into holding tabs 150 of receiver 145 thereby joining first liner connector 120 and second liner connector 140. First liner connector 120 and second liner connector 140, when joined, are adapted to hold shower liner 107 between them.

Figure 2:
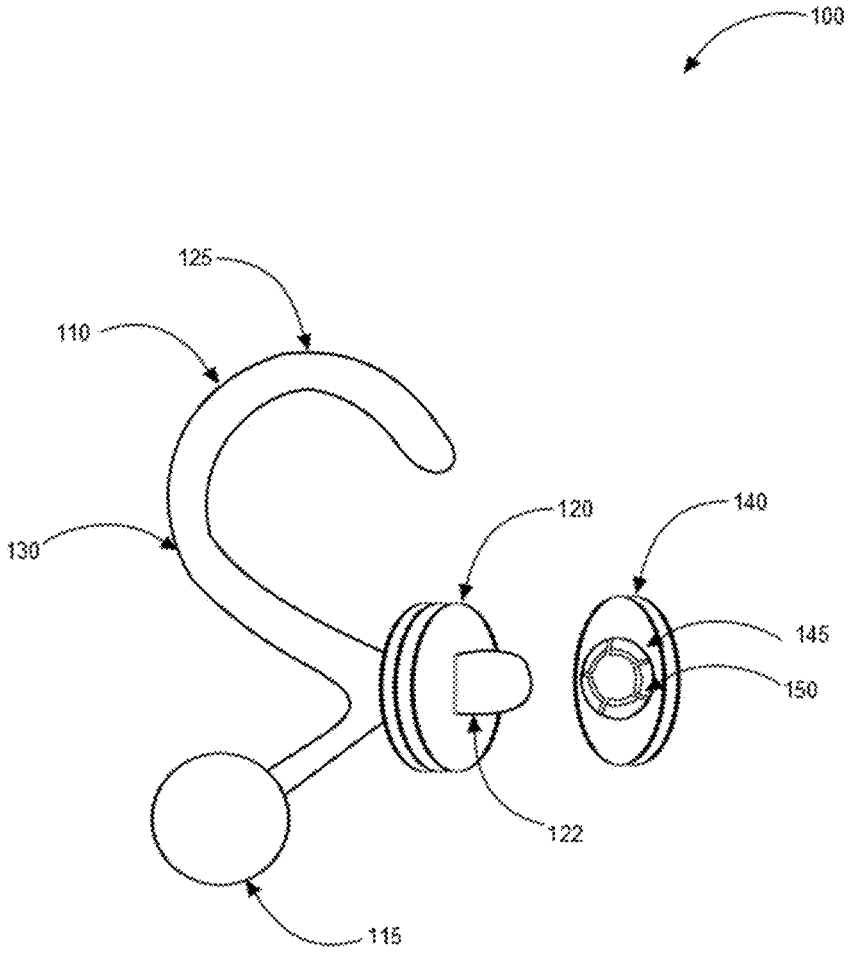
FIG. 2 is a perspective view illustrating a shower curtain hook device according to an embodiment of the present invention of FIG. 1.

Referring now to FIG. 2, a perspective view illustrating shower curtain hook device 100 according to an embodiment of the present invention of FIG. 1.

Curtain suspending member 110, formed from plastic material, includes curtain end 115, first liner connector 120, rod end 125, and connecting section 130 as a continuous unit to form curtain suspending member 110. Second liner connector 140 is also formed from plastic material. Alternately, curtain suspending member 110 and second liner connector 140 may be formed from any suitable material.

First liner connector 120 is formed having a circular shape including a diameter of approximately one inch and a depth, including protrusion 122, of approximately three fourths of an inch. Protrusion 122 is formed as a nipple having a length of approximately three eights of an inch and a diameter of approximately three eights of an inch. First liner connector 120 and protrusion 122 may have any alternate suitable measurements of diameter and depth.

Second liner connector 140 is formed having a circular shape with a diameter of approximately one inch and a depth of approximately three fourths of an inch. Receiver 145 is formed as a circle shape having five holding tabs 150 adapted to accept protrusion 122. Each of five holding tabs 150 is curved having a length of approximately three eights of an inch and a width of approximately one fourth of an inch. Each of five holding tabs 150 is fixedly attached to receiver 145. Protrusion 122 is held in place within holding tabs 150 via friction resulting from protrusion 122 and receiver 145. Second liner connector 140, receiver 145, and holding tabs 150 may have any alternate suitable measurements of diameter and depth to be in conformance with measurements of first liner connector 120 and protrusion 122.

Curtain end 115 is formed having a spherical shape. Curtain end 115 may alternately have any suitable shape. Connecting section 130 is formed having a V-shaped bend adjacent to first liner connector 120. Rod end 125 is formed as a C-shaped hook having an opening measuring approximately one and one half inch. Shower curtain hook device 100 may be available in any number of colors and designs with curtain end 115 having any suitable shape and rod end 125 having any suitable shape.

Figure 3:
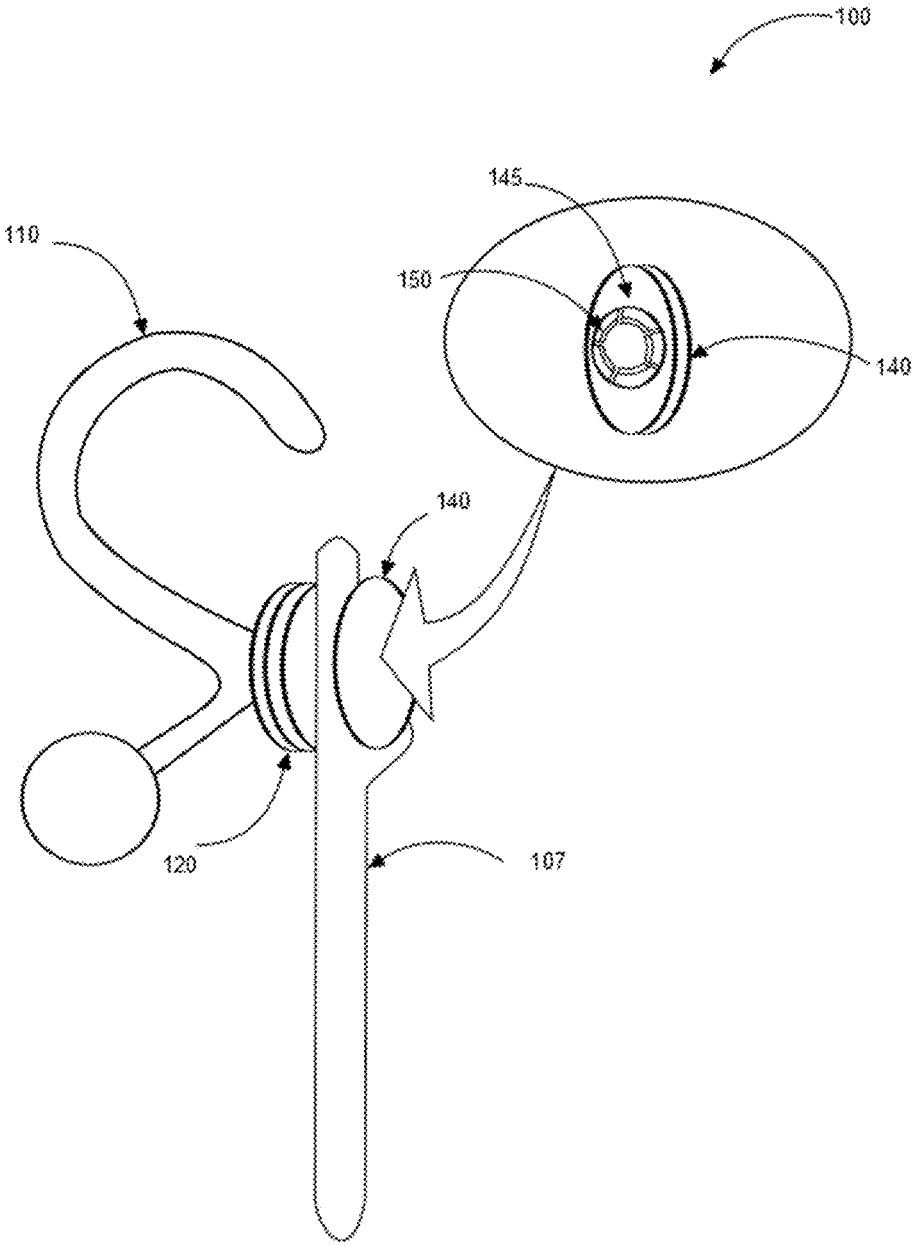
FIG. 3 is a perspective view illustrating a shower curtain hook device according to an embodiment of the present invention of FIG. 1.

Referring now to FIG. 3, a perspective view illustrating shower curtain hook device 100 according to an embodiment of the present invention of FIG. 1.

Shower curtain hook device 100 is a two-piece suspension device for shower curtain 105 and shower liner 107. One piece, curtain suspending member 110 fits over shower curtain rod 108 via rod end 125 and includes a spherical end for loop 106 on shower curtain 105. There is a pair of connectors for shower liner 107. Shower liner 107 is placed between first liner connector 120 and second liner connector 140 and is held in place when the connectors are snapped together. A plurality of the shower curtain hook devices 100, depending on the number of loop 106 in shower curtain 105, is used to suspend shower curtain 105 and shower liner. Protrusion 122 fits into holding tabs 150 of receiver 145 thereby joining first liner connector 120 and second liner connector 140. First liner connector 120 and second liner connector 140, when joined, are adapted to hold shower liner 107 between them.

Figure 4:
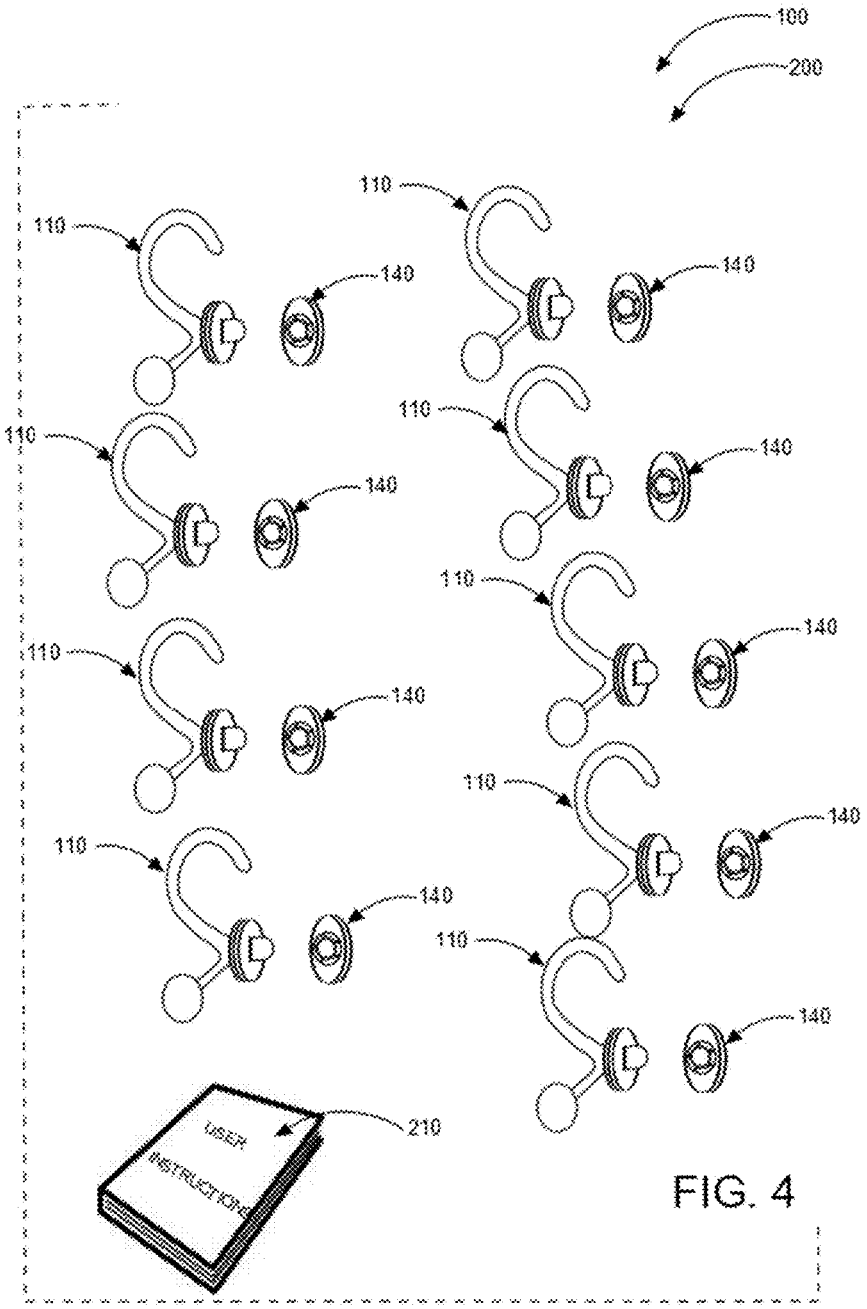
FIG. 4 showing a shower curtain hook device as a kit.

Referring now to FIG. 4, showing shower curtain hook device 100 as kit 200. Shower curtain hook device 100 may be sold as kit 200 comprising the following parts: a plurality of curtain suspending members 110, including curtain end 115, first liner connector 120 with protrusion 122, rod end 125, and connection section 130; a plurality of second liner connectors 140, having receiver 145 and holding tabs 150; and at least one set of user instructions 210. Kit 200 has instructions such that functional relationships are detailed in relation to the structure of the invention (such that the invention can be used, maintained, or the like in a preferred manner). Shower curtain hook device 100 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different color combinations, parts may be sold separately, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A shower curtain hook device for use in removing and replacing a shower curtain and shower liner comprising:

a curtain suspending member adapted to suspend a shower curtain and a shower liner onto a shower curtain rod comprising;

a curtain end adapted to fit into the loop of the shower curtain;

a first liner connector having a protrusion adapted to suspend the shower liner;

wherein said first liner connector is formed having a circular shape including a diameter of approximately one inch and a depth, including said protrusion, of approximately three fourths of an inch;

a rod end adapted to fit onto the shower curtain rod; and a connecting section adapted to join said curtain end, said first liner connector, and said rod end; and a second liner connector having a receiver formed having a circular shape with a center opening and including five holding tabs protruding into said center opening that are adapted to join with said protrusion for suspending the shower liner;

wherein each of said five holding tabs has a curved cross-section and has a length of approximately three eights of an inch and a width of approximately one fourth of an inch;

wherein said protrusion fits into said holding tabs of said receiver and are retained therein via friction therebetween thereby joining said first liner connector and said second liner connector;

wherein said first liner connector and said second liner connector, when joined, are adapted to hold the shower liner between them; and wherein said circular shape of said second liner connector is formed having a diameter of approximately one inch and a depth of approximately three fourths of an inch.

2. The shower curtain hook device of claim 1 wherein said curtain suspending member includes said curtain end, said first liner connector, said rod end, and said connecting section as a continuous unit to form said curtain suspending member.

3. The shower curtain hook device of claim 1 wherein said curtain suspending member is formed from plastic material.

4. The shower curtain hook device of claim 1 wherein said second liner connector is formed from plastic material.

5. The shower curtain hook device of claim 1 wherein said protrusion is formed as a nipple having a length of approximately three eights of an inch and a diameter of approximately three eights of an inch.

6. The shower curtain hook device of claim 1 wherein each of said five holding tabs is fixedly attached to said to receiver.

7. The shower curtain hook device of claim 1 wherein said curtain end is formed having a spherical shape.

8. The shower curtain hook device of claim 1 wherein said connecting section is formed having a V-shaped bend adjacent to said first liner connector.

9. The shower curtain hook device of claim 1 wherein said rod end is formed as a C-shaped hook having an opening measuring approximately one and one half inch.

* * * * *